United States Patent [19]

Fowles et al.

[11] 4,093,093

[45] June 6, 1978

[54] ANTIBACKOFF CLOSURE

[75] Inventors: Thomas A. Fowles, McHenry, Ill.; David A. Winchell, Twin Lakes, Wis.

[73] Assignee: Baxter Travenol Laboratories, Inc., Deerfield, Ill.

[21] Appl. No.: 777,750

[22] Filed: Mar. 14, 1977

[51] Int. Cl.[2] ..... B65D 41/62

[52] U.S. Cl. ..... 215/251; 215/253; 215/232

[58] Field of Search ..... 215/232, 250, 251, 252, 215/553

[56] References Cited

U.S. PATENT DOCUMENTS

| | | | |
|---|---|---|---|
| 2,950,832 | 8/1960 | Brune | 215/252 |
| 3,871,545 | 3/1975 | Bereziar | 215/251 |
| 3,923,179 | 12/1975 | Choksi | 215/251 |
| 3,923,182 | 12/1975 | Choksi | 215/250 |
| 3,923,183 | 12/1975 | Choksi | 215/251 |
| 3,923,184 | 12/1975 | Choksi | 215/251 |
| 3,923,185 | 12/1975 | Choksi | 215/251 |
| 3,937,348 | 2/1976 | Guala | 215/252 |
| 3,945,525 | 3/1976 | Jones | 215/253 |

*Primary Examiner*—Ro E. Hart
*Attorney, Agent, or Firm*—Paul C. Flattery; John P. Kirby, Jr.; Gary W. McFarron

[57] ABSTRACT

A container for storing and dispensing sterile liquids is provided with a hermetically sealed overcap. An outer ring fits over the overcap and the overcap and outer ring have interfitting threads. The outer ring defines a jacking member for moving the overcap axially upwardly on a bottle neck when the outer ring is rotated downwardly. Antibackoff means are provided for axially interlocking the outer ring and overcap, limiting upward rotational displacement of the outer ring with respect to the overcap.

6 Claims, 7 Drawing Figures

ANTIBACKOFF CLOSURE

BACKGROUND OF THE INVENTION

Containers for storing and dispensing sterile liquids are known which have an outer or overcap on the bottle neck. Such containers are in common use for various medical and hospital procedures, such as the administration of irrigating solutions.

Such sterile liquid medical containers have a common purpose of maintaining the sterility of their liquid contents during storage, shipping and dispensing. It is necessary that the closure system be easy for the nurse or physician to open, advantageously by the customary continuous counterclockwise rotation of the closure on the container.

One prior art closure for a container having a neck defining a dispensing outlet is disclosed in Choksi U.S. Pat. No. 3,923,182. The closure includes an overcap fitted on the bottle neck closing the dispensing outlet and connected to the bottle neck to define a hermetic seal. The overcap is threaded on its outer surface. An outer ring fits over the overcap and has internal threads engaged with the threads on the overcap. Downward rotation of the outer ring serves to jack the overcap off the bottle neck, breaking the hermetic seal.

Difficulty has been experienced when the nurse or physician turns the outer ring in the wrong direction, removing the outer ring from the overcap without severing the hermetic seal and removing the overcap. In addition, the outer ring may become disassembled from the overcap during handling or shipment.

Moreover, in the normal assembly operation of the overcap to a bottle neck, the overcap is heat fused to the bottle neck to form the hermetic seal. It is necessary that the overcap be accessible to the heat and pressure die during assembly. Thus difficulty would be experienced if the outer ring were assembled to the overcap prior to sealing on the container, and the outer ring is commonly assembled after installation of the overcap on the container.

SUMMARY OF THE INVENTION

In accordance with the present invention, there is provided an improved container and closure system. The container includes a bottle having a dispensing outlet. A primary cap may be hermetically sealed to the bottle neck. An overcap is assembled on the bottle neck and is hermetically sealed thereto, forming a frangible section. An outer ring is provided over the overcap and is threadingly interconnected therewith.

In operation, rotation of the outer ring serves as a screw jack, the outer ring movement being restricted downwardly by the abutment so as to drive the overcap upwardly to fracture the frangible section thereof.

In accordance with the present invention, axially interlocking means are provided on the overcap and outer ring limiting upward axial displacement of the outer ring. In one embodiment, the interlocking means includes an annular depression or groove in the outer cylindrical side wall surface of the overcap and a reduced diameter rib portion on the inner side wall surface of the outer ring interfitted into the annular depression. Advantageously the reduced diameter rib portion comprises a plurality of slightly flexible fingers projecting into the annular depression. The annular depression is sufficiently wide to provide limited relative travel of the reduced diameter rib portion therein.

The outer ring is readily assembled over the overcap after the overcap has been hermetically sealed to the bottle neck. The outer ring may simply be threaded onto the overcap; the flexible fingers will flex outwardly over the larger diameter upper portion of the overcap, and will snap into the annular depression.

Rotation of the outer ring in a first, conventionally counterclockwise direction will drive the outer ring downwardly against the abutment means and raise the overcap. Rotation of the outer ring in the wrong direction will abut the ends of the flexible fingers against the upper side wall surface of the annular depression and prevent improper removal of the outer ring.

A more detailed explanation of the invention is provided in the following description and claims and is illustrated in the accompanying drawings.

DETAILED DESCRIPTION OF THE ILLUSTRATIVE EMBODIMENT

Figure 1:
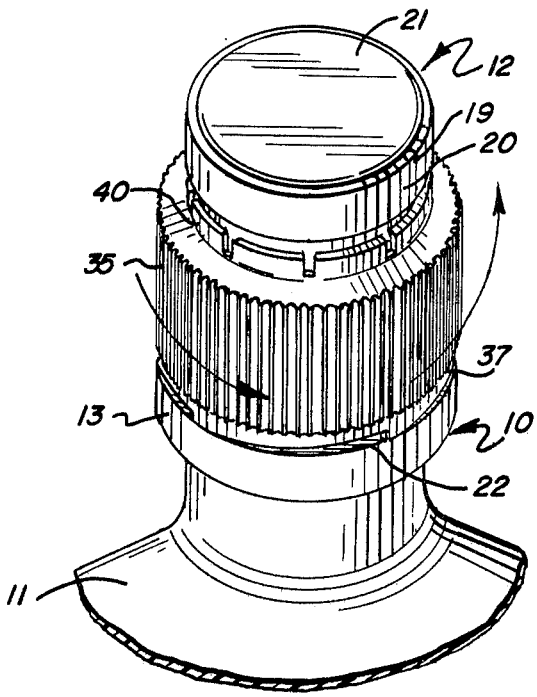
FIG. 1 is a fragmentary perspective view of a container having an improved closure according to the present invention.
Figure 4:
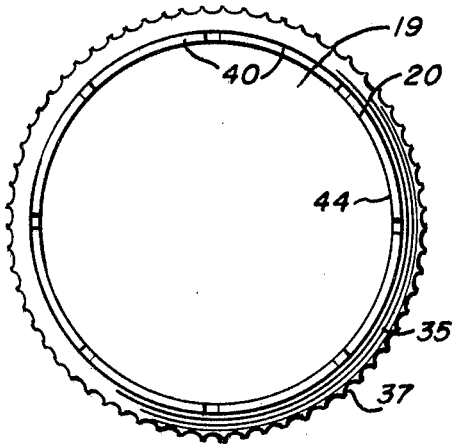
FIG. 4 is a top plan view of the closure of FIG. 1.
Figure 2:
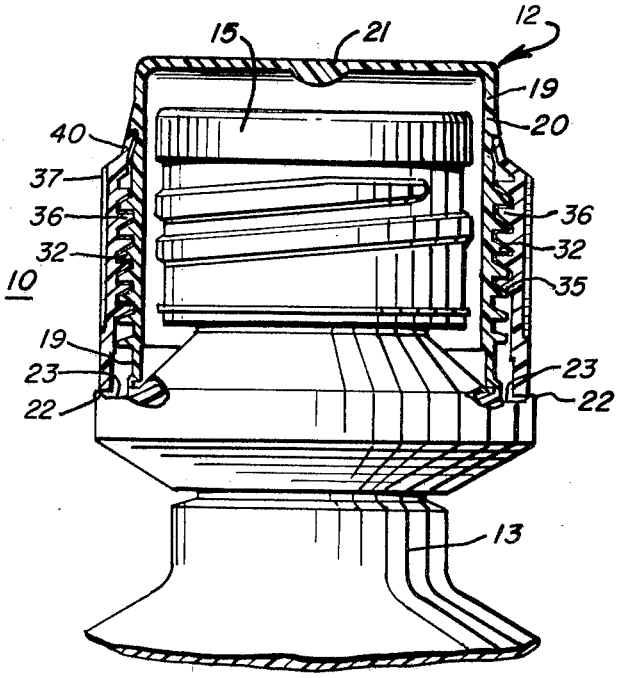
FIG. 2 is a cross-sectional view of the container of FIG. 1.
Figure 5:
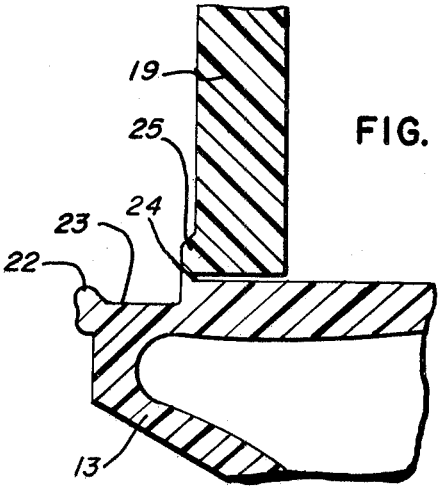
FIG. 5 is an enlarged detail view illustrating the heat and pressure seal of the overcap providing a frangible section.
Figure 7:
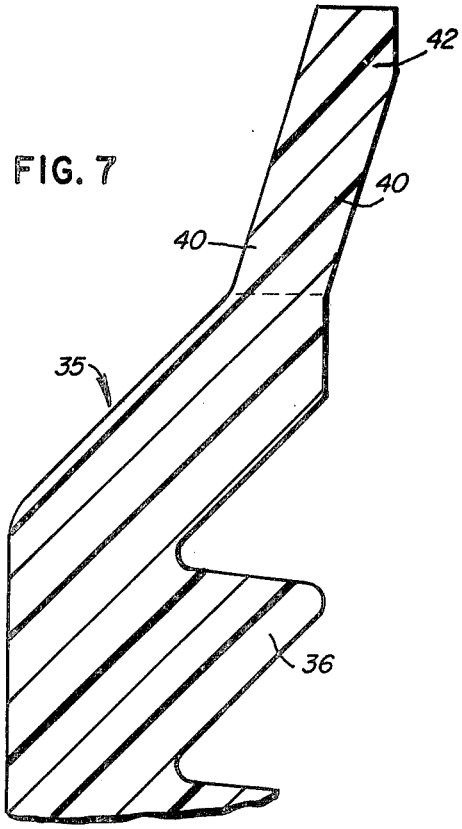
FIG. 7 is an enlarged detail view illustrating one of the flexible fingers of the outer ring.

Referring now to the drawings, there is fragmentarily illustrated a thermoplastic container 10 including a thermoplastic bottle 11 and a thermoplastic closure system 12 contained on a bottle neck 13 of the bottle 11. This container 10 contains sterile medical liquids, such as normal saline, sterile water and the like, and commonly supplied to hospitals. In the illustrative embodiment, the container has a dispensing outlet extending through the bottle neck 13. The dispensing outlet conventionally is sealed by a primary or inner cap 15. The primary cap 15 may be of a known type, which is threadingly connected to the bottle neck, or it may be heat sealed to the bottle, if desired.

In accordance with the present invention, there is provided an overcap 19 covering the primary cap 15 and bottle neck 13. The overcap 19 is formed of thermoplastic material of generally inverted cup shape. Overcap 19 is initially formed with an annular radially outwardly extending flange positioned on bottle neck 13. The overcap 19 is fused to the bottle neck 13 and in the illustrative embodiment, the flange of the overcap has been removed from the overcap and forced into an annular bead 22 as a result of downward heat and pressure, which also forms a depression 23 around the top surface of neck 13. A frangible web or section 24 is thus formed normal to the depression 23 with frangible section 24 forming the vertical side wall of the depression 23. The fracture of the frangible section 24 will occur in tension. A chamfer 25 is provided adjacent frangible section 24.

An annular depression or groove 28 is formed in the outer cylindrical side wall of the overcap 19 proximate the top portion 20 of the side wall of the overcap to provide an annular area of reduced diameter. The annular depression 28 includes a top wall 30 defining a radially outwardly extending abutment and a gradually sloping or tapered lower side wall 31. The overcap 19 is provided with external threads 32 below the annular depression 28, here shown as left-hand threads.

An outer ring 35 is positioned over the overcap 19 and is provided with complementary internal left-hand threads 36 operatively associated with the external threads 32 on the overcap 19. The ring 35 may contain knurling or serrations 37 to assist in holding and turning the outer ring. The outer ring 35 bears within the depression 23 on the bottle neck 13 to define a screw jacking member.

Figure 3:
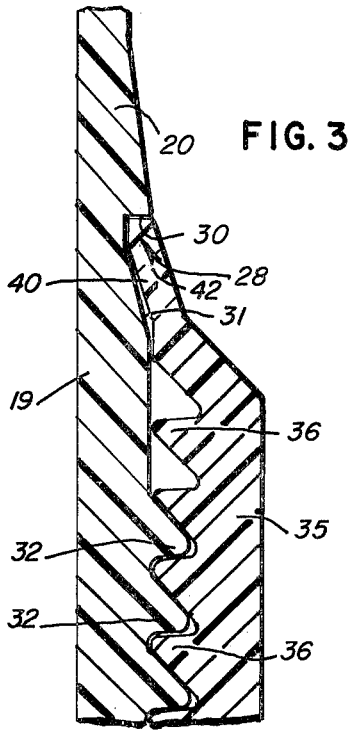
FIG. 3 is an enlarged detail view illustrating the interfitting of the flexible fingers into the annular depression.
Figure 6:
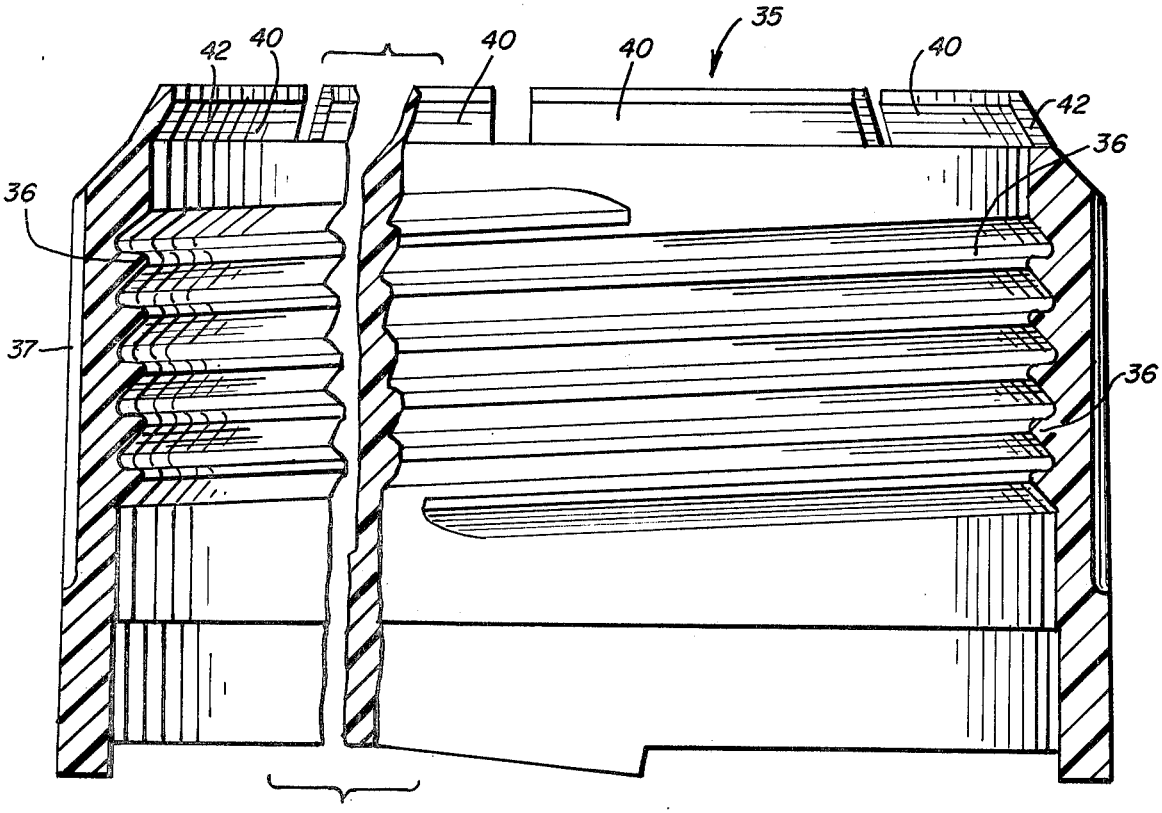
FIG. 6 is a cross-sectional elevation, partially broken, of the outer ring of the container closure of FIG. 1.

Outer ring 35 is provided on the inside of its upper edge with a plurality of slightly flexible fingers 40 protruding inward and upward and collectively interfitted within the annular depression 28 for limiting the relative axial travel of the outer ring 35 upwardly on the overcap 19. Each finger 40 (FIG. 3) has a gradually inwardly sloped arm portion 42. The fingers 40 fit loosely into the annular depression 28 to permit downward axial travel of the outer ring 35 on the overcap 19, when the outer ring is screwed downwardly. The arm portions 42, however, will abut against the top wall 30 of the depression 28 when the outer ring 35 is screwed upwardly on the overcap.

In assembly, the overcap 19 is assembled on the container bottle 11 and hermetically sealed thereto by a heat and pressure die to form the frangible section 24. The outer ring 35 is then screwed onto the overcap 19 and the fingers 40 on the outer ring 35 will flex outwardly until they are lowered to a point where they snap into the depression 28 of the overcap 19. When the closure is assembled, in this manner it is impossible to remove the outer ring from the overcap by upward rotation of the outer ring, as the fingers 40 catch in the depression 28.

Although an illustrative embodiment of the invention has been shown and described, it is to be understood that various modifications and substitutions may be made by those skilled in the art without departing from the novel spirit and scope of the invention.

What is claimed is:

1. An improvement in a hermetically sealed container for storing and dispensing sterile liquids, said container including a bottle with a neck defining a dispensing outlet, said bottle having a transverse abutment means on the neck surrounding the outlet, said improvement comprising, in combination:

an overcap having a cylindrical side wall and a top wall fitted on said bottle neck over said dispensing outlet, said overcap being hermetically sealed to said bottle neck;

an outer ring threadedly interfitted over said overcap and adapted for downward rotation to abut said abutment means and jack said overcap off said bottle neck; and axially interlocking means on said overcap and said outer ring limiting upward displacement of said outer ring with respect to said overcap.

2. An improvement as described in claim 1, wherein said overcap and bottle are formed of thermoplastic material and said hermetic seal comprises a heat fused seal between said overcap and said bottle neck.

3. An improvement as described in claim 1, said interlocking means comprising slightly flexible fingers carried by said outer ring and means defined by said overcap for limiting upward movement of said fingers with respect to said overcap.

4. An improvement in a hermetically sealed container for storing and dispensing sterile liquids, said container including a thermoplastic bottle with a neck defining a dispensing outlet, said bottle having a transverse abutment means on the neck surrounding the outlet, said improvement comprising, in combination:

a cup-shaped overcap having a cylindrical side wall and a top wall over the dispensing outlet and hermetically bonded to the bottle neck, said overcap defining an annular depression in its outer cylindrical side wall surface of a smaller diameter than said side wall proximate the top wall; and an outer ring threadedly interfitting over said overcap and adapted for downward rotation to abut said abutment means and jack said overcap off said bottle neck; said outer ring having a reduced diameter rib portion interfitted within said depression limiting the relative axial travel of said outer ring upwardly on said overcap.

5. The improvement as set forth in claim 4, wherein said rib portion includes a plurality of slightly flexible fingers protruding inwardly into said depression.

6. The improvement as set forth in claim 5, wherein said flexible fingers are assembled over said side wall of said overcap and snapped into said depression; and said flexible fingers are aligned to abut against a downwardly facing annular surface of said depression, limiting relative upward travel of said outer ring.

* * * * *